US005376440A

United States Patent [19]

Koseki

[11] Patent Number: 5,376,440

[45] Date of Patent: Dec. 27, 1994

[54] WOVEN FABRIC FOR SEAT BELT

[75] Inventor: Tomohiro Koseki, Hamamatsu City, Japan

[73] Assignees: Ikeda Bussan Co., Ltd., Ayase City; Hamamatsu Industry Co., Ltd., Hamamatsu City, both of Japan

[21] Appl. No.: 160,146

[22] Filed: Dec. 2, 1993

[30] Foreign Application Priority Data

Mar. 31, 1993 [JP] Japan ..... 5-96743

[51] Int. Cl.[5] ..... D03D 3/00

[52] U.S. Cl. ..... 428/229; 297/483; 428/225; 428/257; 428/258; 428/259; 428/408; 428/902

[58] Field of Search ..... 418/225, 229, 257, 258, 418/259, 408, 902; 297/483

[56] References Cited

U.S. PATENT DOCUMENTS 4,931,345 6/1990 Bottger et al. ..... 428/229
4,983,433 1/1991 Shirasaki ..... 428/257
5,154,965 10/1992 Rouhling ..... 428/229
5,168,006 12/1992 Inoguchi et al. ..... 428/257
5,187,003 2/1993 Chitrangad ..... 428/229
5,187,004 2/1993 Risseeuw ..... 428/229

FOREIGN PATENT DOCUMENTS 54-20732 7/1979 Japan .
60-261474 12/1985 Japan .

*Primary Examiner*—James J. Bell
*Attorney, Agent, or Firm*—Foley & Lardner

[57] ABSTRACT

A woven fabric for a seat belt comprises warp and weft yarns which are combined to constitute a woven base which extends in a given way, and extra yarns which are held in the woven base and extend substantially straightly along the given way. The extra yarns are constructed of a material whose extensibility is lower than that of materials of the warp and weft yarns and whose tensile strength is higher than that of the materials of the warp and weft yarns.

10 Claims, 4 Drawing Sheets

WOVEN FABRIC FOR SEAT BELT

BACKGROUND OF THE INVENTION

1. Description of Prior Art

The present invention relates in general to supplemental restraining systems of motor vehicles, and more particularly, to safety seat belts for restraining passengers upon a vehicle collision or the like. More specifically, the present invention is concerned with woven fabrics for use as a belt proper of the seat belts.

2. Description of the Prior Art

Hitherto, various types of woven fabrics for the safety seat belts have been proposed and put into practical use in the field of motor vehicles and the like. Some of such prior art woven fabrics are of a shock absorbing type which is constructed to absorb shocks applied thereto. That is, as is shown in FIG. 7 of the accompanying drawings, such shock absorbing woven fabric 1 comprises generally warp yarns 2 and weft yarns 3 which are woven in 2/2 or 4/4 twill weaving fashion.

Usually, the warp yarn 2 has a fineness of about 1000 to about 1500 denier, a breaking strength of about 8 to about 10 g/denier and an extensibility of about 10 to 20% in elongation percentage, while, the weft yarn 3 has a fineness of about 500 to 750 denier, a breaking strength of about 5 to about 7 g/denier and an extensibility of about 15 to about 25% in elongation percentage.

Some of such prior art shock absorbing fabrics are disclosed in Japanese Patent Second Provisional Publication 54-20732 and Japanese Patent First Provisional Publication 60-261474. The fabric shown in the 54-20732 publication uses two or more kinds of warp yarns at least one of which is constructed of aromatic polyamide fiber or copolymer fiber of aromatic polyhydrazide-polyamide. The fabric shown in the 60-261474 comprises base yarns and extra yarns which are combined, so that when a shock is applied to the fabric, the base yarns are deformed much greater than the extra yarns.

However, due to the inherent construction, the above-mentioned woven fabrics have failed to exhibit a satisfied initial restraining ability when used as a seat belt. That is, when, due to a vehicle head-on collision of the like, a big force is applied to the seat belt by a belt wearer, the belt is subjected to a considerable elongation causing the belt wearer to largely incline forward. This will be understood from the graph of FIG. 8 in which the relationship between the force applied to the belt 1 and the elongation of the belt 1 is shown. That is, upon application of the force of about 1100 Kg which is common upon a vehicle collision, the belt is subjected to elongation of over 15%.

As is known, the large forward inclination of the belt wearer at such initial stage of the vehicle collision is undesired because of possibility of collision of the belt wearer against a front rigid member. Furthermore, a considerable elongation of the seat belt at such initial stage of the vehicle collision tends to affect the shock absorbing ability possessed by the belt itself.

SUMMARY OF THE INVENTION

It is therefore an object of the present invention to provide a woven fabric for a seat belt, which is free of the above-mentioned drawbacks.

According to a first aspect of the present invention, there is provided a woven fabric for a seat belt. The woven fabric comprises warp and weft yarns which are combined to constitute a woven base which extends in a given way; and extra yarns held in the woven base and extending substantially straightly along the given way, wherein the extra yarns are constructed of a material whose extensibility is lower than that of materials of the warm and weft yarns and whose tensile strength is higher than that of the materials.

According to a second aspect of the present invention, there is provided a woven fabric for a seat belt. The woven fabric comprises warp yarns adjacent two of which extend in a zig-zag manner along a given way while providing a phase difference of 180 degrees therebetween; weft yarns grouped into upper and lower groups and combined with the warp yarns to constitute a woven base which extends along the given way, each warp yarn threading the upper and lower groups of weft yarns alternately in such a manner that the warp yarn passes over two of the upper group of weft yarns and then passes under two of the lower group of weft yarns; extra yarns held in the woven base and extending substantially straightly along the given way, each of the extra yarns being sandwiched between the upper and lower groups of weft yarns, wherein the extra yarns are constructed of a material whose extensibility is lower than that of materials of the warm and weft yarns and whose tensile strength is higher than that of the materials.

BRIEF DESCRIPTION OF THE DRAWINGS

Other objects and advantages of the present invention will become apparent from the following description when taken in conjunction with the accompanying drawings in which.

DETAILED DESCRIPTION OF THE INVENTION

Referring to FIGS. 1 to 6 of the accompanying drawings, there is shown a woven fabric 11 for a seat belt, which is an embodiment of the present invention.

Figure 1:
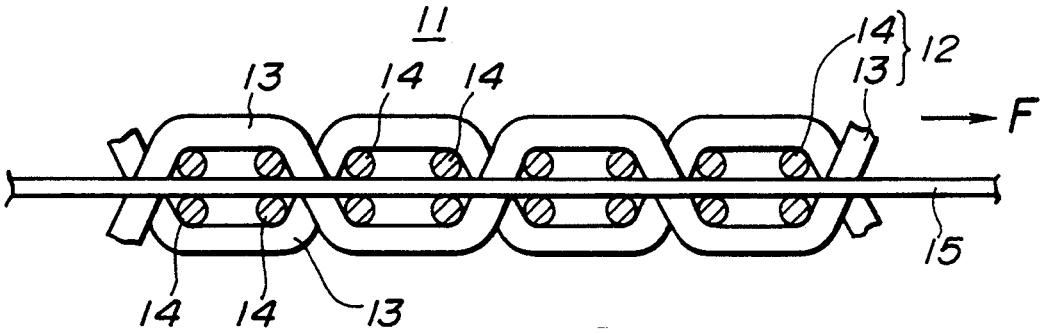
FIG. 1 is an enlarged sectional view of a woven fabric for a seat belt according to the present invention, showing the manner in which warp yarns, weft yarns and extra yarns are combined.
Figure 2A:
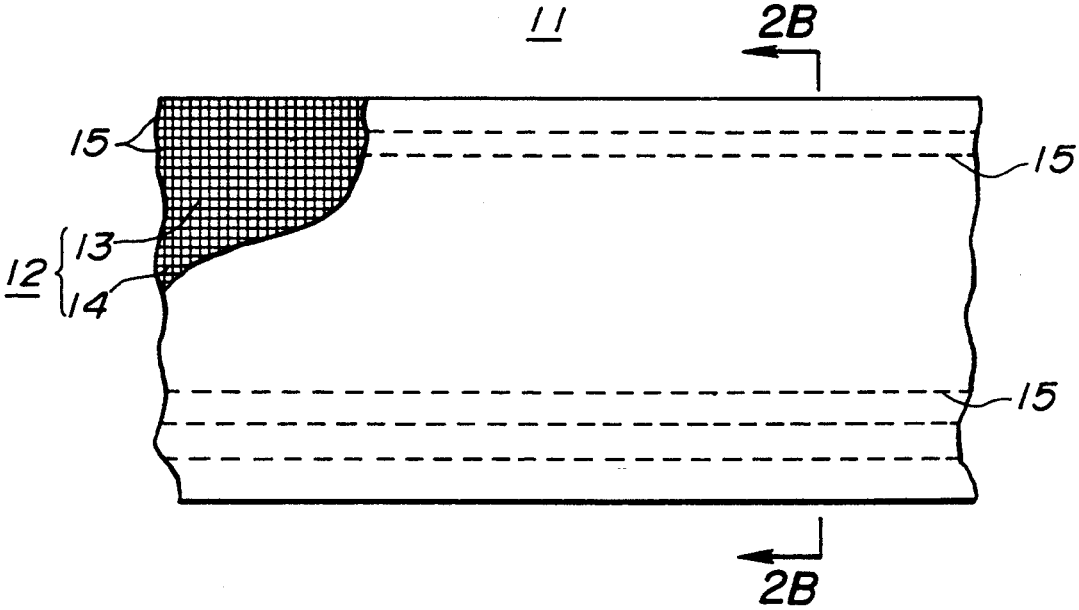
FIG. 2A is a partially broken plan view of the seat belt constructed of the woven fabric of the present invention.
Figure 2B:
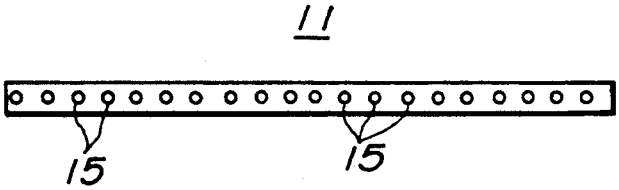
FIG. 2B is a sectional view taken along the line of FIG. 2B—2B of FIG. 2A.

As is seen from FIGS. 1 and 2, the woven fabric 11 of the invention comprises warp yarns 13 and weft yarns 14 which are combined to constitute a woven base 12 of the fabric 11. As shown in FIG. 1, any adjacent two warp yarns 13 extend in a zig-zag manner along a given way while providing a phase difference of 180 degrees therebetween, and the weft yarns 14 are grouped into two, viz., upper and lower groups. Each warp yarn 13 threads the upper and lower groups of weft yarns 14 alternately in such a manner that the warp yarn 13 passes over two of the upper group weft yarns 14 and then passes under two of the lower group weft yarns 14.

A plurality of extra yarns 15 are held in the woven base 12 and extend straightly along the way in which the woven base 12 extends. As is understood from FIG. 2, the extra yarns 15 are equally spaced in the woven base 12 in lateral direction. The extra yarns 15 are constructed of a material which has a low extensibility and a high tensile strength as compared with materials of the warp and weft yarns 13 and 14.

It is to be noted that each extra yarn 15 is sandwiched between upper and lower groups of weft yarns 14, as is seen from FIG. 1. That is, the extra yarns 15 are pressed and gripped by the woven base 12 of the fabric 11.

The warp and weft yarns 13 and 14 are constructed of, for example, a fiber of high-$\eta$ polyester, which has a fineness of lower than 1800 denier, preferably lower than 1700 denier, a tensile strength of lower than 10 g/denier, preferably lower than 7 g/denier, and an extensibility of higher than 15%, preferably higher than 20% in elongation percentage.

The extra yarns 15 are constructed of, for example, a carbon fiber or polyamide fiber which has a fineness of lower than 1500 denier, preferably lower than 1100 denier, a tensile strength of higher than 15 g/denier, preferably higher than 20 g/denier, and an extensibility of lower than 8%, preferably lower than 4% in elongation percentage. Experiments have revealed that when these fibers are used as the material for the extra yarns 15, the seat belt 11 thus produced can exhibit an initial tensile strength of over 2300 kg.

If desired, the extra yarns 15 may be constructed of a polyester fiber which has a fineness of lower than 1500 denier, preferably lower than 1100 denier, a tensile strength of higher than 8 g/denier, preferably higher than 10 g/denier, and an extensibility of lower than 18%, preferably lower than 15% in elongation percentage. Experiments have revealed that when this fiber is used as the material for the extra yarns 15, the seat belt 11 thus produced can exhibit an initial tensile strength of over 1500 kg.

Figure 3:
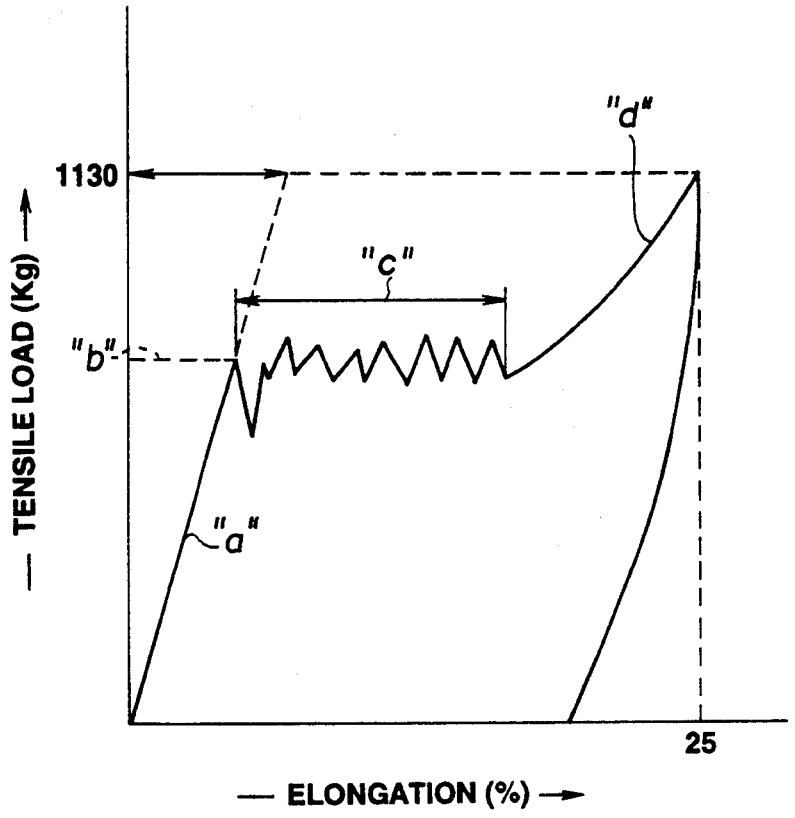
FIG. 3 is a graph showing the performance of the seat belt in terms of a relationship between a force applied to the seat belt and an elongation of the belt.
Figure 4:
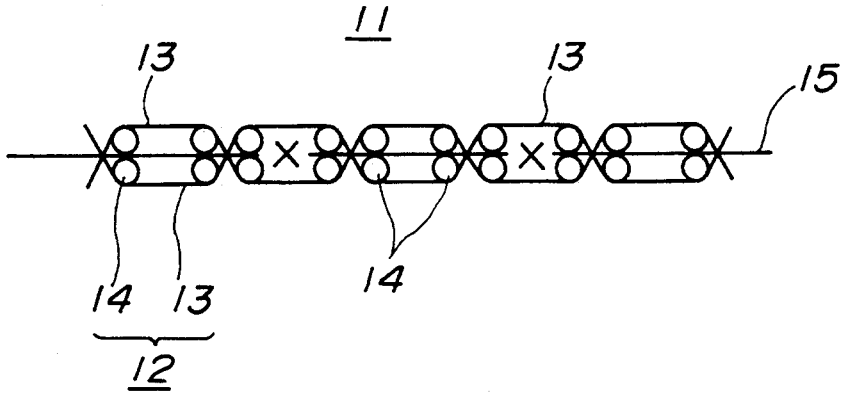
FIG. 4 is a schematically illustrated sectional view of the woven fabric of the present invention in a condition wherein the extra yarns are broken.
Figure 5:
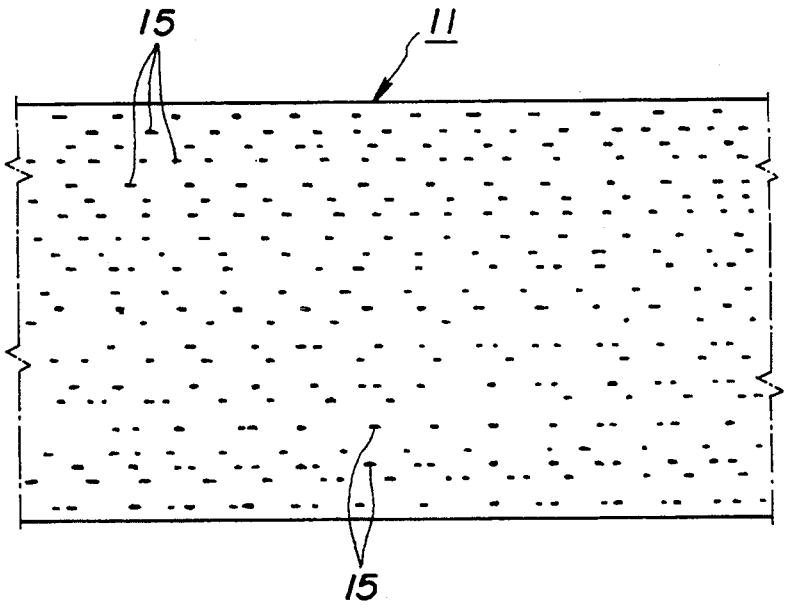
FIG. 5 is a plan view of the woven fabric of the present invention in the condition wherein the extra yarns are broken.
Figure 6:
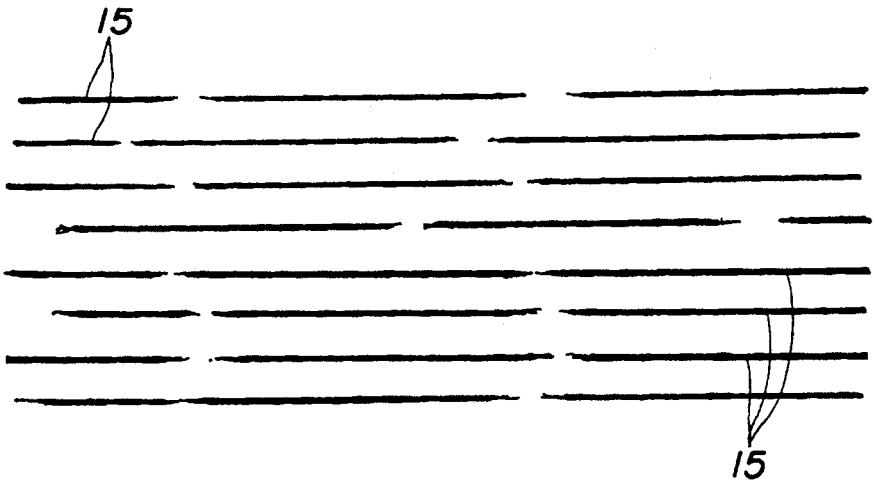
FIG. 6 is an enlarged view showing only the extra yarns which are broken.
Figure 7:
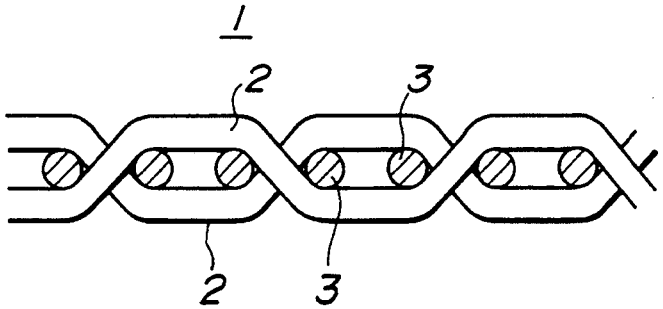
FIG.7 (PRIOR ART)
FIG. 7 is a view similar to FIG. 1, but showing a prior art woven fabric for a seat belt.
Figure 8:
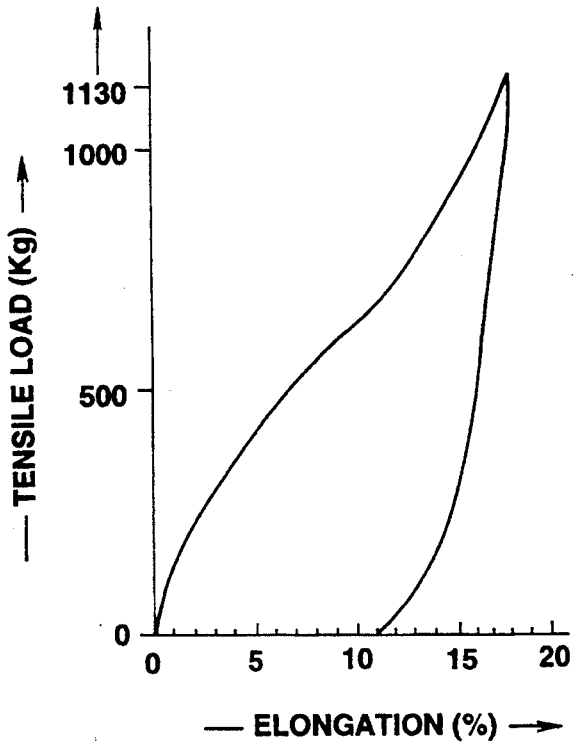
FIG.8 (PRIOR ART)
FIG. 8 is a graph showing the performance of the prior art woven fabric for a seat belt.

FIG. 3 is a graph showing the performance of the seat belt constructed of the woven fabric 11 of the invention in terms of a relationship between a force applied to the belt and an elongation of the belt. It is to be noted that the graph was provided by averaging many data given from several tests.

As is seen from this graph, when the seat belt 11 is applied with a tensile load, the belt 11 shows at an initial stage the character denoted by reference "a". During this initial stage, the warp yarns 13 (see FIG. 1) are stretched causing the upper and lower groups of weft yarns 14 to tightly press and hold the extra yarns 15 therebetween. When the tensile load applied to the belt 11 increases to a certain value "b" (which will be referred to as "fuse load"), the extra fibers 15 become broken as is seen from FIGS. 4 to 6, and thus, the belt 11 shows a dull elongation "c" (which will be referred to as "fuse elongation") at this tensile load "b". After this fuse elongation, the belt 11 is elongated again showing the character denoted by reference "d", and shows about 25% elongation at the load of 1130 Kg.

It is thus to be noted that the character denoted by reference "a" is produced from the combination of all the warp yarns 13, weft yarns 14 and extra yarns 15, the character denoted by reference "c" is caused by the breakage of the extra yarns 15 and the character denoted by reference "d" is produced from the combination of only the warp yarns 13 and weft yarns 14.

As will be understood from the above, the seat belt construction of the woven fabric 11 of the present invention shows only a small elongation fat the initial stage of the vehicle collision, and thus, undesired large forward inclination of a belt wearer at such initial stage can be avoided. The dull elongation of the seat belt 11, which takes place after the initial elongation, can smoothly absorb the shock applied to the belt wearer.

What is claimed is:

1. A woven fabric for a seat belt, comprising:

warp and weft yarns which are combined to constitute a woven base which extends in a given way; and extra yarns held in said woven base and extending substantially straight along said given way, wherein said extra yarns are constructed of a material whose extensibility is lower than that of materials of said warp and weft yarns and whose tensile strength is higher than that of said materials, and wherein any adjacent two of said warp yarns extend in a zig-zag manner along said given way while providing a phase difference of 180 degrees.

2. A woven fabric as claimed in claim 1, in which said weft yarns are grouped into upper and lower groups and in which each of said warp yarns threads said upper and lower groups of weft yarns alternately in such a manner that the warp yarn passes over a given number of upper group weft yarns and then passes under a given number of lower group of weft yarns.

3. A woven fabric as claimed in claim 2, in which said given number is two.

4. A woven fabric as claimed in claim 2, in which the extra yarns are equally spaced in said woven base in lateral direction.

5. A woven fabric as claimed in claim 2, in which each of said extra yarns is sandwiched between the upper and lower groups of weft yarns.

6. A woven fabric as claimed in claim 1, in which said warp and weft yarns are constructed of a fiber of high-$\eta$ polyester, which has a fineness of lower than 1800 denier, a tensile strength of lower than 10 g/denier, and an extensibility of higher than 15% in elongation percentage, and which said extra yarns are constructed of a carbon fiber or polyamide fiber which has a fineness of lower than 1500 denier, a tensile strength of higher than 15 g/denier, and an extensibility of lower than 8% in elongation percentage.

7. A woven fabric as claimed in claim 6, in which the fiber of said warp and weft yarns has a fineness of lower than 1700 denier, a tensile strength of lower than 7 g/denier, and an extensibility of higher than 20% in elongation percentage, and in which the carbon fiber or polyamide fiber has a fineness of lower than 1100 denier, a tensile strength of higher than 20 g/denier, and an extensibility of lower than 4% in elongation percentage.

8. A woven fabric as claimed in claim 1, in which said warp and weft yarns are constructed of a fiber of high-$\eta$ polyester, which has a fineness of lower than 1800 denier, a tensile strength of lower than 10 g/denier, and an extensibility of higher than 15% in elongation percentage, and in which said extra yarns are constructed of a polyester fiber which has a fineness of lower than 1500 denier, a tensile strength of higher than 8 g/denier, and an extensibility of lower than 18% in elongation percentage.

9. A woven fabric as claimed in claim 8, in which the fiber of said warp and weft yarns has a fineness of lower than 1700 denier, a tensile strength of lower than 7 g/denier, and an extensibility of higher than 20% in elongation percentage, and in which the polyester fiber of said extra yarns has a fineness of lower than 1100 denier, a tensile strength of higher than 10 g/denier, and an extensibility of lower than 15% in elongation percentage.

10. A woven fabric for a seat belt, comprising:

warp yarns adjacent two of which extend in a zig-zag manner along a given way while providing a phase difference of 180 degrees therebetween;

weft yarns grouped into upper and lower groups and combined with said warp yarns to constitute a woven base which extends along said given way, each warp yarn threading the upper and lower groups of weft yarns alternately in such a manner that the warp yarn passes over two of the upper group of weft yarns and then passes under two of the lower group of weft yarns;

extra yarns held in the woven base and extending substantially straightly along said given way, each of said extra yarns being sandwiched between the upper and lower groups of weft yarns, wherein said extra yarns are constructed of a material whose extensibility is lower than that of materials of said warm and weft yarns and whose tensile strength is higher than that of said materials.

* * * * *